United States Patent [19]

Beckman

[11] Patent Number: 5,059,314

[45] Date of Patent: Oct. 22, 1991

[54] POOL SKIMMING APPARATUS

[76] Inventor: Bruce W. Beckman, 212 Roxanne Ave., N. Syracuse, N.Y. 13212

[21] Appl. No.: 588,726

[22] Filed: Sep. 27, 1990

[51] Int. Cl.[5] ..... E04H 3/16; E04H 4/12

[52] U.S. Cl. ..... 210/169; 15/1.7; 4/490

[58] Field of Search ..... 15/1.7; 210/169, 416.2; 4/490

[56] References Cited

U.S. PATENT DOCUMENTS

| | | | |
|---|---|---|---|
| 3,152,076 | 10/1964 | Kreutzer | 210/169 |
| 3,244,284 | 5/1966 | Shaffer | 210/169 |
| 3,625,364 | 12/1971 | La Chance | 210/169 |
| 3,774,767 | 11/1973 | Field | 210/169 |
| 4,068,327 | 1/1978 | Heinlein | 210/169 |
| 4,221,662 | 9/1980 | Joseph | 210/169 |
| 4,225,436 | 9/1980 | Cseh | 210/169 |
| 4,379,749 | 4/1983 | Roth | 210/169 |
| 4,720,340 | 1/1988 | O'brien | 210/169 |
| 4,734,189 | 3/1988 | Page, Jr. | 210/169 |
| 4,789,470 | 12/1988 | Wards | 210/169 |
| 4,904,379 | 2/1990 | Ward | 210/169 |
| 4,960,514 | 10/1990 | Paskert | 210/169 |

*Primary Examiner*—Stanley S. Silverman
*Assistant Examiner*—Robert James Popovics
*Attorney, Agent, or Firm*—Katherine McGuire

[57] ABSTRACT

A pool skimming arm for releasable attachment to a side of the water intake port of the pool has two elongated, planar walls disposed at 90° to each other. The skimmer arm when attached to the water intake port, extends toward the center of the pool and acts to divert a larger percentage of the circulating water into the water intake port for filtration thereof. The end of the arm extending toward the center of the pool bends inwardly to prevent backwash of the water around the end of the arm instead of into the intake port as intended.

3 Claims, 1 Drawing Sheet

POOL SKIMMING APPARATUS

BACKGROUND OF THE INVENTION

This invention relates to pool skimming apparatus and, more particularly, to improved pool skimming apparatus which diverts floating debris into the filter inlet of the pool and which includes novel means for the releasable attachment of the skimmer apparatus to the pool such that the skimming apparatus may be removed from the pool as desired, such as when the pool is in use, for example.

Maintenance of a swimming pool typically requires the removal of debris such as leaves, twigs and bugs, which usually float on the water surface until they have become waterlogged, at which point they slowly sink to the bottom. Since it is more difficult an operation to remove debris which collects on the bottom and sides of the pool after it has sunk, it is desirous and more efficient to remove the floating debris before it has a chance to sink.

Many present day pools include a filter and circulation system comprising a water intake incorporated into a wall of the pool in the general location of the normal water level of the pool. Water is drawn into the water intake, pumped to pass through a filter, and forcefully ejected back into the pool absent any entrained debris captured by the filter. The simultaneous operation of the water intake and ejection ports cause circulation of the pool water either in a generally clockwise or counter-clockwise direction, depending on the angle at which the water ejection port ejects the filtered water back into the pool, in addition to any water circulation jets incorporated into the sides of the pool. The typical power of conventional pool water intakes allow only water traveling past and closely adjacent thereto to be forcefully drawn into the water intake port. Due to this fact, much of the debris floating near the center of the pool is never caught in the water intake port and filtered out as is intended. To overcome this problem, apparatus has been developed over the years which takes the general form of an elongated arm attached to extend at an angle from one side of the water intake port. The elongated arm acts to divert debris floating within its reach into the water intake port to thereby be pumped through the pool filter.

Patent No. 3,152,076 issued to Kruetzer on Oct. 6, 1964 discloses an elongated wand W which floats upon the water surface and is attached at one end to a vertical shank 20 by means of a bracket 30. The shank extends from pool coping 10 adjacent water inlet 12. It is evident that the shape of wand W permits only debris floating directly on the surface of the water to be diverted into the inlet, i.e., it does not extend significantly below the water surface to divert semi-submerged debris into the inlet. Also, it is stated at col. 2, lines 49–51 that the wand may be removed from the pool when the pool is used for swimming by moving the bracket 30 downwardly off from shank 20. It is again evident that shank 20 remains affixed to coping 10 and extends into the water with a blunt end, thereby posing a danger to swimmers who might injure themselves through inadvertant contact with shank 20.

A list of more recent patents disclosing a pool debris diverter of varying construction and pool attachment means include Patent No. 3,244,284 issued to Shaffer on Apr. 5, 1966; Patent No. 3,774,767 issued to Field on Nov. 27, 1973; Patent No. 4,068,327 issued to Heinlein on Jan. 17, 1978; Patent No. 4,221,662 issued to Joseph on Sep. 9, 1980; Patent No. 4,379,749 issued to Roth on Apr. 12, 1983; Patent No. 4,734,189 issued to Page, Jr. on Mar. 29, 1988; Patent No. 4,789,470 issued to Wards on Dec. 6, 1988; and Patent No. 4,904,379 issued to the same inventor Ward on Feb. 27, 1990.

The present invention is concerned primarily with its improved and novel method of attachment to the pool, in addition to its superior debris diverting ability, the features of which are lacking in the aforementioned, prior patents.

It is therefore a main object of the present invention to provide pool skimming apparatus in the form of an elongated arm which includes novel means for quick and easy attachment to, and removal from, the side of the water intake port of the pool.

It is a further object to provide pool skimmer apparatus to augment existing pool skimmer/filter systems and which is efficient at removing substantially all of the floating and semi-submerged, circulating debris from a swimming pool.

It is another object to provide pool skimming apparatus which includes pool attachment parts for the elongated skimmer arm which are fixedly mounted to a side of the water intake port of the pool and which are configured such that they do not pose a danger of injury to swimmers who may come in inadvertant contact therewith when the skimmer arm is removed therefrom.

It is still another object to provide pool skimming apparatus which is simple in design and use yet fully effective at diverting debris into the water intake port and pool filter of the pool.

It is yet another object to provide pool skimming apparatus which comprises a minimum amount of parts whereby the apparatus may be manufactured at little cost and therefore be very economically attractive to manufacturers and consumers alike.

Other objects will in part be obvious and in part appear hereinafter.

SUMMARY OF THE INVENTION

In accordance with the foregoing objects, the invention comprises an elongated, L-shaped skimming arm having two planar walls disposed perpendicularly to each other at their edges. One end of the skimming arm includes a protruding shaft or bar for attachment of the arm to a slotted bracket mounted to a side of the water intake port of the pool. The opposite end of the skimming arm, which extends toward the center of the pool, includes a small length of the arm being bent in a direction away from the protruding bar at approximately 74° from the axis of the longer length of the arm to which the bar is attached at the opposite end.

As water circulates in the pool to constantly pass by the water intake port located on the side of the pool, the skimmer arm acts to divert floating and semi-submerged debris into the water intake port which would have otherwise bypassed the water intake port. When swimmers wish to use the pool, the bar may be slidingly removed from the mounting bracket and the skimmer arm removed from the pool. The mounting bracket is configured for close alignment with the pool wall such that the possibility that a swimmer would injure themselves upon it is minimal.

DETAILED DESCRIPTION

Figure 1:
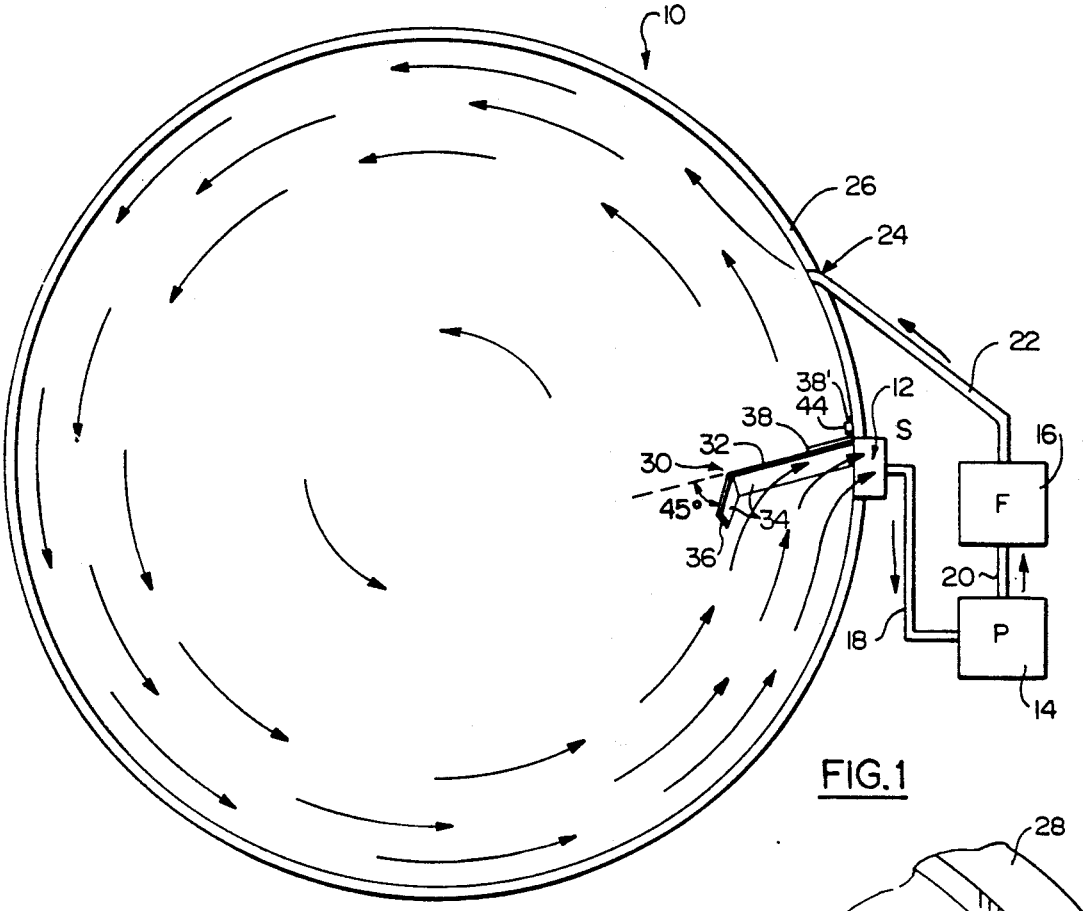
FIG. 1 is a top, plan view of a circular swimming pool including the skimmer arm attached adjacent the water intake port thereof and showing the pool circulating and filter system in simplified block diagram form.

Referring now to the drawings, there is seen in FIG. 1 a circular pool denoted generally by the reference numeral 10. Most pools today such as pool 10 include a water circulation and filtering system comprising a skimmer or water-intake port 12, pump 14, and filter 16, including associated piping 18, 20, and 22, respectively connecting each in series. Water in the pool is drawn into water-intake port 12 and delivered through pipe 18 to pipe 20 via pump 14. Pump 14 acts to pump the water from pipe 20 into filter unit 16 wherein any debris entrained in the water is filtered out. The cleansed water is then pumped through pipe 22 and delivered forcefully back into pool 10 at outlet port 24. The outlet port 24 is typically disposed at an angle with respect to the wall 26 of the pool 10 such that the force of the water being discharged into the pool at an angle, in addition to the suction of water therefrom through water-intake port 12, causes circulation of the pool water in the direction of the directional arrows seen in FIG. 1. There may also be water jets incorporated into the sides of the pool to cause the desired water circulation although none are shown in the present Figures for purposes of clarity. Also, although a circular pool 10 is described in conjunction with the invention herein, it is to be understood that various shaped pools having water filter systems causing pool water circulation in various directions may also be used with the present invention as will be understood more fully from the ensuing description.

Figure 2:
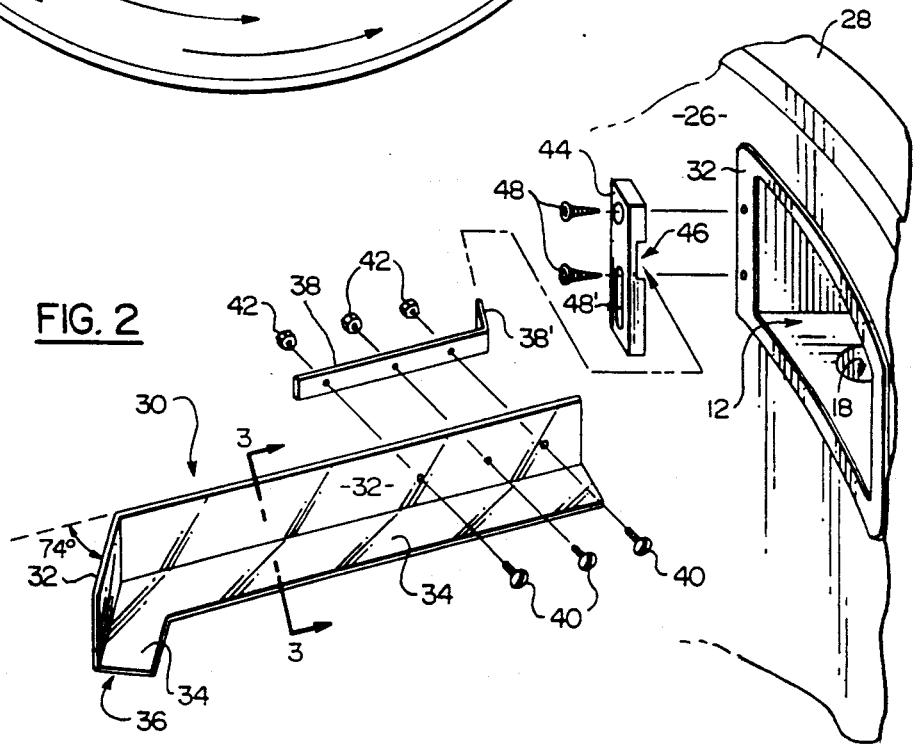
FIG. 2 is an exploded, perspective view showing the skimmer arm and water-intake port mounting assembly thereof.

Referring to FIG. 2, it is seen water-intake port 12 is located adjacent pool coping 28 whereby the water level typically maintained in pool 10 reaches intake port 12. In this way, water in the pool which passes near intake port 12 is drawn therein by pump 14. In most pool systems, the water intake power created by pump 14 is only strong enough to capture water which passes closely adjacent intake port 12. It is therefore evident that water passing further away, toward the center of the pool, will not be drawn into intake port 12 and passed through filter 16 to capture floating debris entrained therein.

Figure 3:
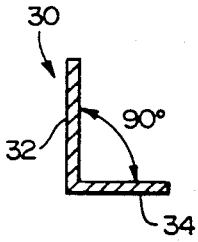
FIG. 3 is an elevated, cross-sectional view of the skimmer arm taken along the line 3-3 in FIG. 2.

Skimmer arm 30 is thus provided for attachment to the side 32 of intake port 12 to divert a larger percentage of circulating water into intake port 12 than would normally be drawn therein without skimmer arm 30. Skimmer 30 is preferably constructed of a rigid plastic such as acrylic whereby it may be molded as one piece and be compatible with the pool water as well as any chemicals diluted therein. Arm 30 is seen to include a first planar wall 32 and a second planar wall 34 integrally extending perpendicularly therefrom as seen most clearly in the cross-sectional view of FIG. 3. As seen in FIGS. 1 and 2, walls 32 and 34 sharply bend at approximately a 74° angle at a point approximately an eighth of arm 30's length from end 36 the purpose of which will be described below. The assembly for mounting arm 30 to side 32 of intake port 12 includes an L-shaped metal bar 38 fixedly mounted to the face of wall 32 facing away from wall 34 by means of bolts and nuts 40 and 42, respectively. Length 38' of bar 38 thereby extends substantially perpendicularly from wall 32 in a direction away from wall 34.

An elongated bracket 44 having recess 46 is mounted to side 32 of intake port 12, with recess 46 facing port 12, by means of screws 48. It is seen that the bottom screw hole 48' is vertically elongate such that intake ports having side wall screw openings of varying distances apart may be accommodated by moving the screw 48 up or down within bottom screw hole 48' until it is aligned with its respective screw hole located on side 32 of intake port 12.

With bracket 44 thus mounted to side 32 of intake port 12 in accordance with the above, recess 46 forms a slot with side 32 wherethrough perpendicularly extending length 38' of bar 38 may be inserted. Arm 30 is thus firmly attached to side 32 of intake port 12 as seen in FIG. 1, with wall 32 positioned vertically and wall 34 positioned horizontally in the pool. The angle at which arm 30 extends from intake port 12 may be varied by changing the angle at which length 38' extends from the bolted portion of bar 38; however, it has been determined that arm 30 performs best when extending out at a small angle toward the oncoming, circulating water, rather than it extending straight out from the intake port 12, i.e., perpendicular to wall 26.

In the attached position, the circulating water in the pool which passes adjacent intake port 12 is diverted by arm 30 into intake port 12 as seen by the directional arrows of FIG. 1. The water level in the pool is somewhere between the top and bottom of intake port 12 and, by virtue of horizontal wall 34 of arm 30, a significant depth of water is diverted into intake port 12, typically between 12 to 38 inches of the water surface. In this way, not only debris floating directly on the surface is diverted, but also any semi-submerged debris located up to 3 inches down from the water surface.

The angling of arm 30 at the portion including end 36 prevents water which has encountered wall 32 from passing around end 36 instead of into intake port 12 wherein it is filtered as intended. When swimmers wish to use the pool, arm 30 is easily removed by sliding bracket portion 38' out of recess 46. Bracket 44 is small enough and lays flat against side 32 of intake port 12 such that it does not pose a danger to swimmers who may bump up against it.

What is claimed is:

1. Apparatus for diverting a portion of the top surface of circulating pool water into the water inlet port of a pool filtering system, said apparatus comprising:

a) a skimmer arm having two elongated, planar walls disposed at substantially a 90° angle to each other along respective long edges thereof with one of said planar walls being vertically positioned and the other being horizontally positioned, and said planar walls forming a bend at a first end of said skimmer arm; and b) means for releasable attachment of a second end of said skimmer arm to a vertical side of said water inlet port, said means comprising:

i) an elongated bar fixedly mounted at said second end on the surface of the vertically positioned said planar wall facing away from the horizontally positioned said planar wall, said bar having a terminal length thereof extending away from said surface at a substantially 90° angle therefrom; and ii) an elongated mounting bracket including means for fixed attachment to said vertical side of said water inlet port, said bracket including a slot for releasably receiving said bar terminal length such that said skimmer arm extends along the surface of said circulating pool water in a direction away from said water intake port when releasably attached to said bracket, said circulating water which impinges upon said planar walls being directed therealong and into said water intake port.

2. The invention according to claim 1 wherein said bend forms an acute angle with the linear axis of said planar walls at said first end.

3. The invention according to claim 1 wherein said means for fixed attachment of said bracket comprise a pair of spaced screw holes wherein at least one of said screw holes is elongated to align with respective screw holes on said vertical side of said water inlet port.

* * * * *